US005937784A

United States Patent [19]

Beers

[11] Patent Number: 5,937,784

[45] Date of Patent: Aug. 17, 1999

[54] APPARATUS AND METHOD FOR REPLACING FLOTATION UNDER FLOATING DOCKS

[76] Inventor: Chis Y. Beers, S. 3925 Freeman Dr., Medical Lake, Wash. 99022

[21] Appl. No.: 09/199,067

[22] Filed: Nov. 24, 1998

[51] Int. Cl.[6] ..... B63B 35/38

[52] U.S. Cl. ..... 114/263; 114/267; 405/219

[58] Field of Search ..... 405/219, 220; 114/263, 266, 267

[56] References Cited

U.S. PATENT DOCUMENTS

| | | | |
|---|---|---|---|
| 3,074,238 | 1/1963 | De Golian | 114/263 |
| 4,041,716 | 8/1977 | Thompson | 61/48 |
| 4,365,577 | 12/1982 | Heinrich | 114/267 |
| 4,418,634 | 12/1983 | Gerbus | 114/263 |
| 4,803,943 | 2/1989 | Corbett | 114/263 |
| 4,962,716 | 10/1990 | Fransen et al. | 114/263 |
| 5,133,276 | 7/1992 | Alesi, Jr. et al. | 112/263 |
| 5,281,055 | 1/1994 | Neitzke | 405/291 |
| 5,347,948 | 9/1994 | Rytand | 114/263 |

*Primary Examiner*—Ed L. Swinehart

*Attorney, Agent, or Firm*—Keith S. Bergman

[57] ABSTRACT

A flotation element for placement under a floating dock provides an elongate rectilinear flotation block carrying two spaced upper surface beams on its upper surface, and two spaced lower surface beams on its lower surface. The upper surface beams extend from one end of the flotation block to project beyond the second end, where they define holes to interconnect a tension member, and the lower surface beams extend between the ends of the flotation block. For use, a pulling support carrying a pulling device having an elongate flexible tensile element is positioned on or adjacent to the dock. The flotation element is placed on a first dock side, the pulling device is supported to move the tensile element toward the second dock side, and the tensile element is passed beneath the dock and attached to the projecting ends of the upper surface beams. The flotation element is angulated downwardly and toward the pulling device and the tensile element is moved toward the pulling device to move the flotation element beneath the dock. The pulling device may be supported spacedly distant from the dock to allow direct pulling by the tensile element or on the dock to allow indirect pulling over a pulley supported spacedly outwardly from the second dock side.

6 Claims, 2 Drawing Sheets

FIG. 3
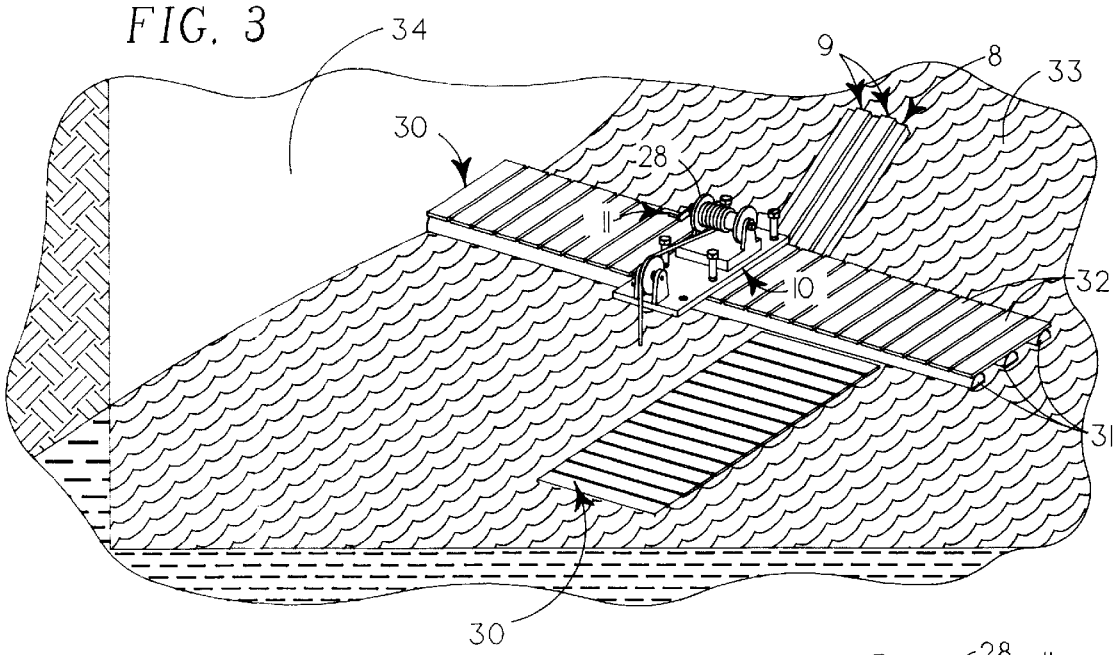
FIG. 4
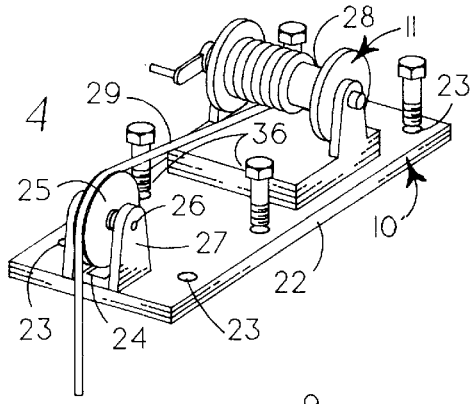
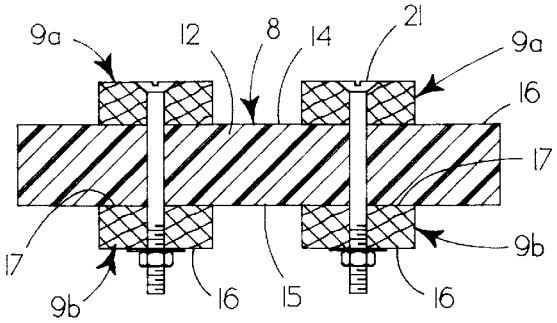
FIG. 2
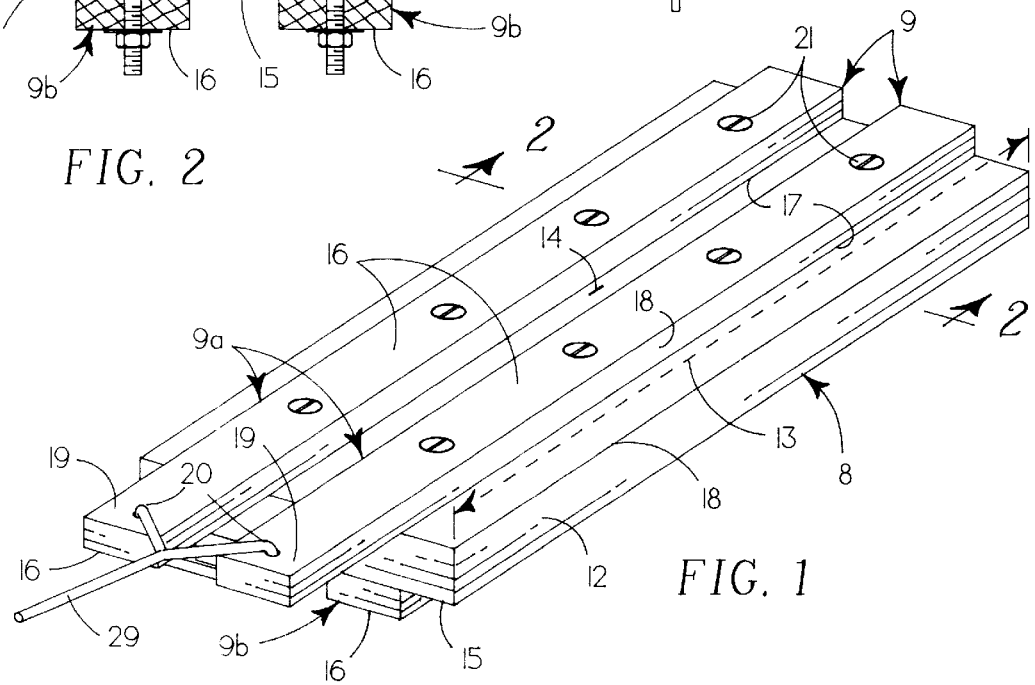
FIG. 1

APPARATUS AND METHOD FOR REPLACING FLOTATION UNDER FLOATING DOCKS

BACKGROUND OF INVENTION

RELATED APPLICATIONS

There are no applications related hereto heretofore filed in this or any foreign country.

FIELD OF INVENTION

This invention relates generally to floating docks, and more particularly to a retrofitable flotation element and method for its placement under a dock.

BACKGROUND AND DESCRIPTION OF PRIOR ART

It often becomes necessary to replace flotation elements beneath a floating dock structure because of the failure of the pre-existing flotation elements to serve their intended purpose. Replacement of flotation elements presents problems, especially with smaller docks, as the replacement elements have to be moved downwardly within the water body supporting the dock to allow placement beneath the floating dock. This often requires substantial mechanical force which is difficult to apply to the replacement element and the process is made more difficult as at the same time the element is moved downwardly in the water body it must also be moved horizontally to position it under the dock. The instant invention provides a simple and economic replacement element that has structure to aid its placement to resolve this problem, especially when the flotation material comprises commonly used non-cased styrofoam blocks.

Most private recreational docks and many smaller commercial docks are formed with a framework having at least two spacedly adjacent lineal side elements extending in an elongate direction with a plurality of structurally attached adjacent decking boards extending in generally perpendicular orientation therebetween. Flotation elements for such docks may comprise the side elements themselves, such especially as in the case of docks formed with logs for flotation, or separate flotation devices may be carried between, beneath or adjacent the side elements which then merely constitute a supporting framework between the flotation elements and the dock decking material. Flotation elements for docks in the modern day generally comprise elongate logs or cased or non-cased foamed plastic materials, though various more sophisticated and expensive flotation devices of a complex nature are known and used, but to a substantially lesser degree. All such flotation devices, and especially the log and non-cased foamed plastic devices, may lose their flotation capabilities over a period of time for various reasons such as by becoming water logged, by accidental or animal caused physical damage, by general deterioration and decrepitude or otherwise. When this occurs, additional flotation material generally must be provided to maintain a dock as a practically usable structure.

One common method of supplying additional flotation capability to docks requiring it is to place floating foamed plastic elements beneath the existing dock structure. Foamed polymerized styrene, especially of a closed cell type, has become popular for this purpose, as it provides an economical flotation material with low density that provides substantial flotation potential. Most retrofitable foamed plastic flotation material has been in the form of non-encased, rectilinearly configured elements that are sufficiently compressed or otherwise densified to provide reasonable configurational stability, but such elements provide little strength especially against shear or impact forces. The encasement of such styrofoam elements in stronger, more rigid material has been known and practiced for some time, but some encased elements have not become popular, largely because of their substantially greater cost and more difficult handling. My retrofitable flotation element uses non-encased foamed plastic elements carrying additional structure that allows placement of the element under floating docks by a simple and easy method without physically damaging the element.

To provide strength and protection for my retrofitable flotation body in distinguishment from prior devices, paired wooden beams are established in spaced relationship inwardly adjacent each of the side edges of the upper and of the lower surfaces of the body. These wooden beams are structurally attached to the body with the beam outer surfaces spacedly outwardly from the outer peripheral surface of the body to provide not only additional strength and rigidity but also a skidding surface for moving the body beneath a dock without damage. The two surface beams on the upper surface of the body extend spacedly distant beyond one body end to provide an entry ramp structure to direct the body beneath a dock for placement. The outer end portions of the upper beam extensions define holes for interconnection with a tension element to pull the flotation element downward and laterally for placement.

A distinctive new process establishes the block beneath a floating dock. A pulling device having a movable tension element is positioned on a first side of a dock so that it can pull in a direction somewhat perpendicular to side elements of a dock. The flotation element is positioned on the second dock side distal from the pulling device and the tension element is interconnected beneath the dock to the block. The tension element is then moved in angulated orientation downwardly and toward the pulling device until the flotation body is beneath the dock.

The pulling device may be positioned on a support adjacent to the dock or on the dock under which the flotation element is being placed. If the pulling device is positioned on the dock being serviced, the pulling support provides a pulley spacedly outwardly distant from the first dock side to allow the tension element to extend under the dock.

My invention lies not in any one of these features individually, but rather in the synergistic combination of all of its structures and methods which necessarily give rise to the functions flowing therefrom.

SUMMARY OF INVENTION

My flotation element provides an elongate, rectilinear foamed plastic flotation body structurally carrying opposed pairs of surface beams in spaced parallel array on its upper and lower surfaces. The surface beams on the upper surface project spacedly beyond one end of the flotation body and have means at the outer end portions for attachment of a tension member. The peripherally outer surfaces of at least the upper surface beams extend spacedly outwardly from the peripherally outer surface of the flotation body.

For placement, the flotation element is positioned on a first side of a dock and a pulling device having an elongate tensile element is supported to exert pulling force on the flotation element from the second side of the dock somewhat perpendicularly thereto. The tensile element is interconnected beneath the dock to the projecting portions of the upper surface beams and pulled adjacent the first dock side with the projecting portions of the upper surface beams extending in angulated orientation downwardly beneath the dock sides and toward the pulling device. The tension element is moved toward the pulling device and the flotation element is responsively moved downwardly and in a lateral direction beneath the dock. The pulling device may be supported laterally adjacent the dock or on the dock being serviced.

In creating such a device, it is:

A principal object to provide a retrofitable flotation element having an elongate rectilinear, foamed polymeric flotation body carrying pairs of spaced surface beams on its upper and lower surfaces to provide rigidity, strength and protection for the element and to aid placement of the body beneath a floating dock.

A further object is to provide such a flotation element wherein the upper surface beams extend spacedly beyond the flotation body and have means in their outer end portions for interconnection with a tension element.

A further object is to provide such a flotation element that may be placed under a floating dock by connecting a tension element to the outer ends of the outwardly projecting upper surface beams and moving the tension element from the side of the dock opposite that on which the flotation element is positioned to responsively move the flotation element under the dock.

A further object is to provide a pulling device carrying the tension element that may be positioned on the dock being serviced by use of a pulley carried spacedly outwardly from the dock side distal from the flotation element to carry the tension element for extension under the dock to the upper surface beams.

A still further object is to provide such a flotation device that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement, with only one preferred and practical embodiment being illustrated in the accompanying drawings and specified, as is required.

BRIEF DESCRIPTION OF DRAWINGS

In the accompanying drawings which form a part hereof and wherein like numbers of reference refer to similar parts throughout:

FIG. 1 is an isometric surface view of my flotation element.

FIG. 2 is a transverse, vertical cross-sectional view of the flotation element of FIG. 1, taken on the line 2—2 thereon in the direction indicated by the arrows.

FIG. 3 is an isometric surface view of a dock structure carrying a pulling device support with supported pulling device on the dock being serviced.

FIG. 4 is an enlarged isometric surface view of the pulling device support and supported pulling device shown in FIG. 3.

DESCRIPTION OF THE PREFERRED EMBODIMENT

Figure 5A:
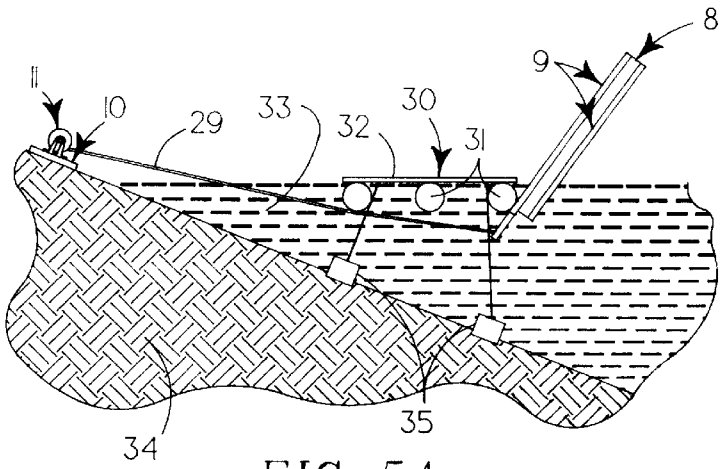
FIGS. 5A–5D show in semi-diagrammatic form the method of moving my flotation element beneath a dock structure by a pulling device supported on the earth adjacent a water body supporting the dock.

My flotation element generally provides flotation body 8 having peripherally projecting surface beams 9 for use with pulling device support 10 carrying pulling device 11 to move the flotation element under floating dock 30.

Flotation body 8 provides low density block 12 of elongate rectangular parallelepiped configuration, normally with one dimension substantially greater than the other two mutually perpendicular dimensions. For convenience of expression hereinafter, the longer dimension of the flotation body will be referred to as its length 13 and the surfaces of major area will be referred to respectively as upper surface 14 and lower surface 15 as determined by the orientation illustrated in the drawings.

The block 12 is formed of some material having a density less than that of water, and for any practical utility the density must be substantially less than that of water, while at the same time the body must have sufficient coherence, strength and rigidity to be configurationally sustaining under ordinary conditions of use. The preferred material for formation of the block is foamed polymeric or resinous plastic, and especially foamed polymeric styrene, because of its desirable physical properties, economy and relative availability. Such material is commonly available in lengths ranging up to at least twenty feet and in varying cross-sectional configurations and dimensions. My invention is particularly concerned with the use of this or similar material in an uncovered and non-encased form, though covered or encapsulated material may be used and is within the ambit and scope of my invention.

Surface beams 9 are rectilinear elements of elongate configuration having outer surfaces 16, inner surfaces 17 and longer side edges 18. The lower surface beams 9*b* preferably have a length the same as the length of flotation body 8 and are structurally carried in spaced parallel relationship on the lower surface 15 of the block 12, between the block ends and spacedly inwardly from the longer side edges 18 of the block, as illustrated in FIG. 1.

Upper surface beams 9*a* have a length longer than the length of flotation body 8 and are structurally carried in spaced parallel relationship on the upper surface 14 of the block 12. First adjacent ends of the upper surface beams are aligned with a first end of the block and with the lower surface beams 9*b*, while second projecting ends 19 of the beams extend beyond the second end of the block. The outer portions of projecting ends 19 define holes 20 to accept flexible tensile member 29 for fastenable interconnection. Preferably, though not necessarily, the upper and lower surface beams 9 have similar cross-sections and the pair of upper beams 9*a* are positioned in vertical alignment with the pair of lower beams 9*b*. The outermost upper and lower peripheral surfaces 16 of both upper and lower surface beams project peripherally outwardly a spaced distance from the proximal peripheral surface of the block 12 carrying them to provide a skidding surface, additional strength and protection for the upper and lower surfaces of block 12.

The surface beams 9 preferably are formed of some material having appropriate rigidity, durability and strength that has a density less than the density of water so as to provide additional flotation potential for the flotation element, or at least not effectively lessen the flotation potential that the body has. The material of preference for these beams is wood, though other materials of similar nature such as solid or hollow rigid polymeric or resinous plastics or even peripherally defined lighter metal beans having flotation voids may be used. The structural interconnection of the surface beams with the flotation body block, in the instance illustrated, is accomplished by nut-bolt combinations fastenably extending between the elements, but this interconnection may also be accomplished by other known means such as adhesion or other known mechanical fasteners. If mechanical fasteners are used, any peripherally outwardly projecting portions of the fasteners that could project peripherally outwardly beyond at least the outer peripheral surfaces of the upper surface beams 9*a* should be countersunk so that those beam surfaces effectively may serve as skids.

Pulling device support 10 provides elongate, rectilinear base 22 defining plural spaced holes 23 to receive fasteners 36 for positional maintenance on a supporting surface. The forward or outer end of the base defines medial slot 24 to allow mounting of pulley 25 journaled on axle 26 carried in spaced cooperating mounting brackets 27 supported by the base on each side of slot 24. The pulling device support 10 is particularly adaptable for fastening on the upper surface of a dock being serviced, near the area beneath which a flotation device is to be positioned, but it also may be used to support a pulling device on some support structure spacedly distant from a dock to be serviced or on the earth itself.

Pulling device 11, in the form illustrated, provides winch 28 carrying flexible, extensible tensile member 29 of appropriate length to serve its purpose. Although a winch is illustrated, this is not intended to be limiting and the pulling device 11 may comprise most known mechanical devices that can shorten the length of a flexible tensile member 29 extending therefrom, preferably with some mechanical advantage such as come-alongs, blocks and tackle, hoists, jacks, screws and the like. The pulling device may be of either a manually or mechanically powered type.

Having described the structures of my invention, its use and operation may be understood, particularly with reference to the somewhat diagrammatic cross-sectional views of FIGS. 5A–5D.

Dock 30 with which my invention is used commonly is an elongate structure formed in essence by at least two spaced elongate support members 31, which commonly but not necessarily are of a flotation nature, carrying perpendicularly laterally extending decking 32 to form an upper dock surface. Commonly the support members and decking will be formed of wood, with the former comprising logs and the latter comprising sawn boards. The various dock elements are interconnected to form a unitary structure by mechanical connectors such as nails, bolts, cables, screws or the like. It is possible, but not so common, that all or part of the dock members may be formed of plastic of various types and possibly even metallic elements with or without flotation chambers, though neither material is so common as wood. A dock to be serviced will be floating on water body 33 and usually communicates with or is reasonably close to the earth 34 forming a shoreline of that water body.

The configuration and dimension of flotation element 8 may vary widely while remaining within the ambit and scope of my invention, but in general it will be of an elongate nature with the length not greater than the width of a dock under which the flotation element is to be placed so that the flotation element will not interfere with the use of the dock, such as for swimming or positioning small boats in adjacency thereto. The cumulative dimensions of the flotation element are determined largely by the flotation characteristics desired for the particular flotation element.

The length of projecting end portions 19 of upper surface beams 9*a* is somewhat critical as it must be great enough to allow those projecting ends to extend at least to the lower surface of a dock structure when the flotation element is positioned in angulated orientation adjacent one side of a dock, as illustrated in FIG. 5A. Normally this requires a projection of approximately eighteen to thirty-six inches. The maximum amount of the projection is not critical, but if that maximum be too great it may make placement of the flotation element more difficult.

For use, a flotation element 8 and pulling device support 10 with pulling device 11 attached are created according to the foregoing specification. In the instance illustrated in FIG. 5A, dock 30 is positioned with its longer dimension somewhat parallel to a shoreline. In this instance the pulling device support 10 is positioned on the shore at a point somewhat perpendicularly adjacent to the position whereat the flotation element is to be placed. The tensile member 29 is extended from pulling device 11, moved under dock 30 and to the far side of the dock where it is temporarily retained. Flotation element 8 is positioned on the side of the dock distal from the pulling device and tension member 29 is interconnected to the projecting end portions 19 of upper surface beams 9*a* by passing it through holes 20 and fastening, in the instance illustrated by looping it upon itself, as illustrated in FIG. 1.

Figure 5B:
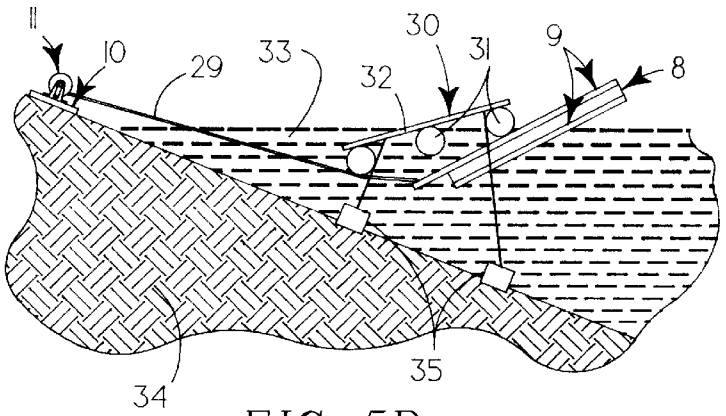
Figure 5C:
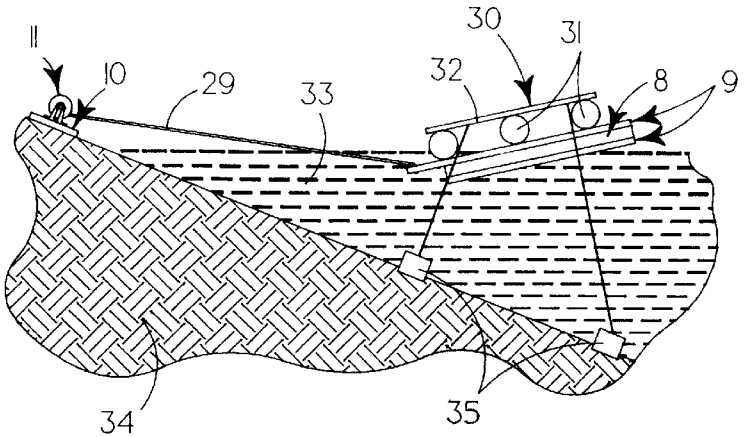
Figure 5D:
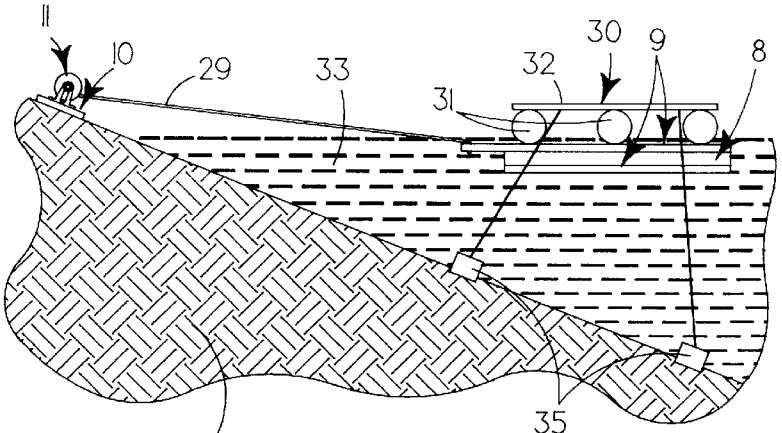

The tension element 29 is then moved toward the pulling device 11 by its operation and the flotation element 8 is manipulated so as to assume the angulated position illustrated in FIG. 5A, wherein the protruding portions 19 of upper surface beams 9*a* extend in angulated orientation downwardly beneath elongate support members 31 of the dock and toward the pulling device. Force is applied to the tension element 29 by the pulling device to move the tension element toward the pulling device, while the flotation element is maintained in its angulated position. As this occurs the flotation element will move further beneath the dock as illustrated in FIG. 5B and ultimately as the outer end of the tension element moves further toward the pulling device, the flotation element will move under the dock as illustrated in FIG. 5C until it ultimately will come to rest under the dock as illustrated in FIG. 5D.

At this point, the tension element 29 is disconnected from the upper surface beams 9*a* and the flotation element 8 is in position to provide its flotation capabilities to support of the floating dock structure which now rests on the upper surfaces of the upper beams. The projecting end portions 19 of the upper surface beams then may be severed, preferably at the adjacent edge of the block 12, so that no part of the flotation element projects beyond the dock structure.

It is to be noted that during the placement of my flotation element beneath a dock, the upper surface beams 9*a* will serve as skids on the adjacent portions of the dock beneath which it is moved and will generally prevent the dock structure from damaging the flotation element. It is further to be noted that during flotation element placement the dock may be positionally maintained, especially against lateral displacement toward the pulling device, by normal, usually pre-existing anchoring structures 35, in the case illustrated comprising cables attached to anchors supported in the bed of water body 33 which supports the dock.

The foregoing description of my invention is necessarily of a detailed nature so that a specific embodiment of it might be set forth as required, but it is to be understood that various modifications of detail, rearrangement and multiplication of parts and of steps of processes might be resorted to without departing from its spirit, essence or scope.

Having thusly described my invention, what I desire to protect by Letters Patent, and

What I claim is:

1. A flotation element for placement beneath a floating dock, comprising in combination:

an elongate flotation block having substantially planar upper and lower surfaces and first and second ends defining its elongate extension;

spaced upper surface beams carried on the upper surface of the flotation block to extend between the ends and beyond the second end, and paired spaced lower surface beams carried on the lower surface of the flotation block to extend between the ends, said surface beams extending peripherally outwardly a spaced distance from the adjacent peripheral surface of the flotation block carrying them, the upper surface beams having first and second ends with the first ends coplanar with the first end of the flotation block and the second ends projecting spacedly beyond the second end of the flotation block, the lower surface beams extending between the first and second ends of the flotation block, and the projecting end portions of the upper surface beams defining means for interconnecting a tension element.

2. The flotation element of claim 1 wherein the flotation block is formed of closed cell foamed polymeric plastic.

3. The flotation element of claim 1 wherein the flotation block is configured as a rectangular parallelepiped with side edges extending between the end and the surface beams are substantially parallel to each other and to the side edges of the flotation block.

4. The flotation element of claim 1 wherein the longest dimension of the flotation block between the ends is not greater than the width of a dock beneath which the flotation element is to be placed.

5. The method for placing the flotation element of claim 1 beneath a dock floating in a water body having first and second sides and, comprising the steps of:

placing the flotation element in the water body on a first side of the dock with projecting ends of the upper surface beams adjacent the dock;

supporting a pulling device having an elongate tensile element movable toward and away from the pulling device with the tensile element movable toward a second side of the dock;

passing the tensile element beneath the dock to the first side of the dock and connecting the tensile element with the outwardly projecting portions of the upper surface beams;

moving the tensile element toward the second side of the dock while maintaining the flotation device in angulated orientation in the water body extending downwardly and toward the pulling device, with the outermost second end of the projecting end portions of the upper surface beams beneath the dock; and pulling the flotation device beneath the dock responsive to motion of the tension element toward the second side of the dock.

6. The method of claim 5 wherein the pulling device is supported on the dock beneath which the flotation element is to be placed on a pulling device support having a pulley carried spacedly outwardly from the second side of the dock with the tension element extending from the pulling device over the pulley and thence beneath the dock.

* * * * *